US011110307B1

(12) United States Patent
Possible

(10) Patent No.: US 11,110,307 B1
(45) Date of Patent: Sep. 7, 2021

(54) GAS TANK STORAGE BAG

(71) Applicant: Kathiana Possible, Elkins Park, PA (US)

(72) Inventor: Kathiana Possible, Elkins Park, PA (US)

( * ) Notice: Subject to any disclaimer, the term of this patent is extended or adjusted under 35 U.S.C. 154(b) by 0 days.

(21) Appl. No.: 16/852,624

(22) Filed: Apr. 20, 2020

(51) Int. Cl.
*A62B 25/00* (2006.01)
*A45F 3/04* (2006.01)
*A45F 3/00* (2006.01)

(52) U.S. Cl.
CPC ..... *A62B 25/00* (2013.01); *A45F 2003/003* (2013.01); *A45F 2003/045* (2013.01)

(58) Field of Classification Search
CPC ..... A62B 25/00; A45F 2003/045; A45F 2003/003
USPC ..... 224/637, 628; D3/216, 229
See application file for complete search history.

(56) References Cited

U.S. PATENT DOCUMENTS 34,336 A * 2/1862 Sweeney ..... A45F 3/04 224/628
2,838,085 A * 6/1958 Beeler ..... A62B 25/00 190/115
3,105,359 A * 10/1963 Ellis ..... B63C 11/08 405/186
4,109,692 A * 8/1978 Brown ..... A61M 16/10 215/12.1
4,267,868 A * 5/1981 Lowe ..... A45C 7/0063 383/2
4,276,669 A * 7/1981 Suba ..... B63C 9/20 441/89
4,336,899 A * 6/1982 Price, II ..... A45F 3/14 224/609
4,383,528 A * 5/1983 Eppolito ..... A62B 9/04 128/204.18
4,438,764 A * 3/1984 Eppolito ..... A62B 9/04 128/204.18
4,739,913 A * 4/1988 Moore ..... A62B 9/04 128/205.22
4,804,218 A * 2/1989 Hilliard ..... B63C 11/22 294/157
4,979,659 A * 12/1990 Boyd ..... A45F 3/14 128/205.22
5,131,576 A * 7/1992 Turnipseed ..... A45F 3/08 224/262
5,267,815 A * 12/1993 Feder ..... B63C 11/22 405/186
D343,510 S * 1/1994 Langlois ..... D3/316
5,423,586 A * 6/1995 Fuller ..... A45C 3/00 294/149
5,427,290 A * 6/1995 Thatcher ..... A45F 3/04 224/148.2

(Continued)

*Primary Examiner* — Justin M Larson
(74) *Attorney, Agent, or Firm* — The Iwashko Law Firm, PLLC; Lev Ivan Gabriel Iwashko

(57) ABSTRACT

A gas tank storage bag, including a cylindrical main body to store at least one item therein, a back support pad disposed on at least a portion of the cylindrical main body to prevent at least a portion of the cylindrical main body from collapsing in response to movement thereto, a shoulder strap assembly disposed on at least a portion of a top portion of the cylindrical main body to suspend the cylindrical main body from shoulders of a user, and a waist strap assembly disposed on at least a portion of a bottom portion of the cylindrical main body to connect around a waist of the user.

6 Claims, 1 Drawing Sheet

(56) References Cited

U.S. PATENT DOCUMENTS 5,511,846 A * 4/1996 Fuller ..... A45C 3/00 294/149
6,003,744 A * 12/1999 Culjak ..... A62B 25/00 128/205.22
6,012,411 A * 1/2000 Hochbrueckner .... F17C 13/002 116/200
D419,762 S * 2/2000 Riley ..... D3/216
D472,047 S * 3/2003 Vazquez ..... D3/244
D486,945 S * 2/2004 Brock ..... D29/126
6,729,758 B1 * 5/2004 Carter ..... B65D 29/02 220/592.19
6,932,364 B2 * 8/2005 Koronowski ..... A45C 5/14 280/37
D528,657 S * 9/2006 Adams ..... D24/128
D536,526 S * 2/2007 Leighton ..... D3/316
7,201,383 B2 * 4/2007 Gibby ..... B62B 1/125 220/622
7,255,245 B2 * 8/2007 Oliveira ..... F17C 13/084 220/586
7,316,435 B2 * 1/2008 Leighton ..... A45C 11/00 150/154
7,341,377 B1 * 3/2008 Baxter ..... A45C 11/00 294/159
7,373,947 B2 * 5/2008 Trettin ..... F17C 13/084 137/355.16
7,387,304 B1 * 6/2008 Rich ..... B62B 1/14 280/47.131
7,520,549 B2 * 4/2009 Leighton ..... A45C 11/00 150/154
7,644,819 B2 * 1/2010 Gill ..... B65D 85/20 206/446
D616,196 S * 5/2010 Walsh ..... D3/217
7,753,589 B2 * 7/2010 Palt ..... F17C 13/084 383/66
8,123,581 B2 * 2/2012 Aschauer ..... A45F 3/04 441/80
8,181,833 B2 * 5/2012 Wangeby ..... A45F 3/14 224/627
D699,031 S * 2/2014 Clavette ..... D3/216
8,893,940 B2 * 11/2014 Green ..... A45F 3/08 224/628
D728,942 S * 5/2015 Byham ..... D3/316
9,101,788 B2 * 8/2015 Allan ..... A62B 25/00
9,259,067 B2 * 2/2016 Kruse ..... A45C 3/00
9,321,404 B1 * 4/2016 Mellenthin ..... F17C 13/084
10,540,880 B1 * 1/2020 Brooks ..... A45C 15/00
10,627,052 B2 * 4/2020 Cook ..... F17C 13/084
D887,526 S * 6/2020 St. Juste ..... D23/206
10,821,309 B2 * 11/2020 Zhu ..... A62B 25/00
2005/0011520 A1 * 1/2005 Rowe ..... A62B 25/00 128/205.22
2005/0275233 A1 * 12/2005 Leighton ..... F17C 13/084 294/152
2006/0060624 A1 * 3/2006 Duncan ..... A45F 3/14 224/602
2006/0102675 A1 * 5/2006 Bezak ..... A45F 3/047 224/628
2006/0144400 A1 * 7/2006 Grassl ..... A45F 3/10 128/205.22
2007/0101995 A1 * 5/2007 Chornyj ..... A62B 25/00 128/205.22
2008/0073355 A1 * 3/2008 Akbar ..... F17C 13/084 220/562
2009/0229613 A1 * 9/2009 Grilliot ..... A62B 17/003 128/205.22
2010/0052293 A1 * 3/2010 Brooks ..... A61M 16/101 280/651
2014/0061263 A1 * 3/2014 Flem ..... A45F 3/08 224/261
2016/0228731 A1 * 8/2016 Sacknoff ..... A62B 9/006
2019/0360639 A1 * 11/2019 Schneider ..... F17C 9/00
2020/0353194 A1 * 11/2020 Volmer ..... G08B 21/0453

* cited by examiner

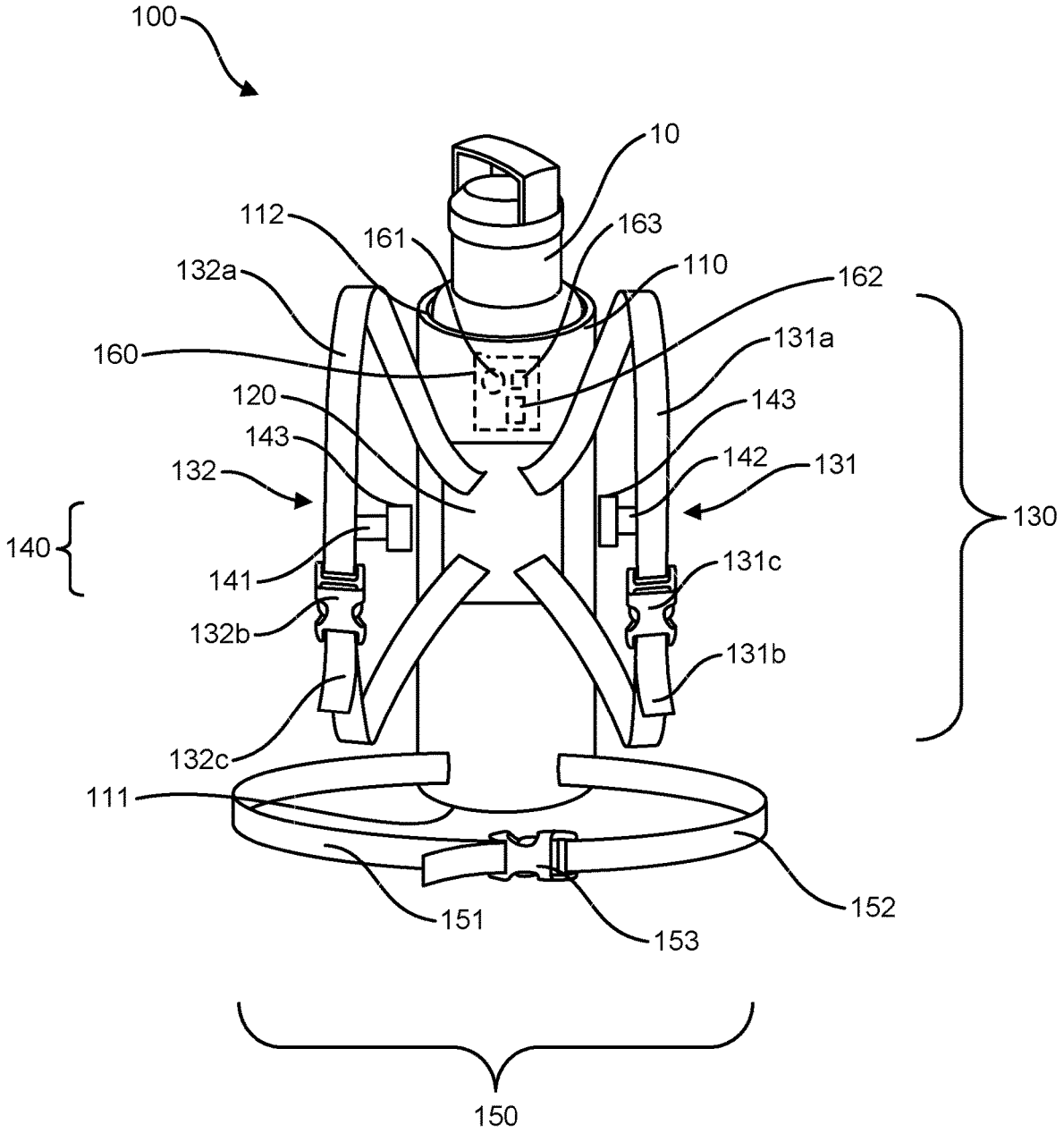
100
10
112
161
163
132a
110
162
160
131a
120
143
143
142
132
131
140
130
141
131c
132b
131b
132c
111
151
153
152
150

GAS TANK STORAGE BAG

BACKGROUND

1. Field

The present general inventive concept relates generally to a storage bag, and particularly, to a gas tank storage bag.

2. Description of the Related Art

Carbon dioxide ($CO_2$) tanks are essential tools utilized for refrigeration and cooling in various professions and/or projects that require $CO_2$. Typically, each $CO_2$ tank weighs a considerable amount, which makes transportation difficult. In particular, people will need to lift and/or carry the $CO_2$ tanks prior to usage. Moving the $CO_2$ tank often causes difficulty for a transporter and creates a harmful environment for people in range of the $CO_2$ tanks.

The transporter has to use his or her hands to get the job done. As such, the transporter may suffer injury to his or her back and/or hands.

Therefore, there is a need for a gas tank storage bag to facilitate transporting the $CO_2$ tanks by removing the need to use hands.

SUMMARY

The present general inventive concept provides a gas tank storage bag.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a gas tank storage bag, including a cylindrical main body to store at least one item therein, a back support pad disposed on at least a portion of the cylindrical main body to prevent at least a portion of the cylindrical main body from collapsing in response to movement thereto, a shoulder strap assembly disposed on at least a portion of a top portion of the cylindrical main body to suspend the cylindrical main body from shoulders of a user, and a waist strap assembly disposed on at least a portion of a bottom portion of the cylindrical main body to connect around a waist of the user.

The back support pad may be more rigid with respect to the cylindrical main body.

The gas tank storage bag may further include a chest strap assembly disposed on at least a portion of the shoulder strap assembly to connect around a chest of the user.

The gas tank storage bag may further include a gas detection unit disposed on at least a portion of the cylindrical main body to activate an alarm unit in response to detection of at least one of an emission of gas and a physical impact to the cylindrical main body.

The gas detection unit may illuminate a light on an outer surface of the cylindrical main body in response to detection of the emission of gas, and emit a sound on an interior surface of the cylindrical main body in response to detection of the physical impact to the cylindrical main body.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a front perspective view of a gas tank storage bag, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Gas Tank Storage Bag 100
Main Body 110
Base 111
Aperture 112
Back Support Pad 120

Shoulder Strap Assembly 130
First Shoulder Strap 131
First Section 131*a*
Second Section 131*b*
First Shoulder Strap Fastener 131*c*
Second Shoulder Strap 132
First Section 132*a*
Second Section 132*b*
Second Shoulder Strap Fastener 132*c*
Chest Strap Assembly 140
First Chest Strap 141
Second Chest Strap 142
Chest Strap Fastener 143
Waist Strap Assembly 150
First Waist Strap 151
Second Waist Strap 152
Waist Strap Fastener 153
Gas Detection Unit 160
Gas Detection Sensor 161
Alarm Unit 162
Power Source 163

FIG. 1 illustrates a front perspective view of a gas tank storage bag 100, according to an exemplary embodiment of the present general inventive concept.

The gas tank storage bag 100 may be constructed from at least one of metal, plastic, and rubber, etc., but is not limited thereto.

The gas tank storage bag 100 may include a main body 110, a back support pad 120, a shoulder strap assembly 130, a chest strap assembly 140, a waist strap assembly 150, and a gas detection unit 160, but is not limited thereto.

The main body 110 may be constructed of nylon to resist damage due to usage of the main body 110, such as carrying at least one item 10 (i.e. a gas tank) therein and/or contact by an external object on an outer surface of the main body 110. In other words, the main body 110 may be durable to resist damage in response to being struck by the external object and/or dropped on a ground surface.

Referring to FIG. 1, the main body 110 is illustrated to have a cylindrical shape. However, the main body 110 may be a rectangular prism, rectangular, circular, conical, pentagonal, hexagonal, octagonal, or any other shape known to one of ordinary skill in the art, but is not limited thereto.

The main body 110 may include a base 111 and an aperture 112, but is not limited thereto.

The main body 110 may store the at least one item 10 therein. For example, the main body 110 may store a cylindrical gas tank, but the main body 110 may store any shape of gas tank. Also, the main body 110 may be constructed to have a predetermined size based on a preference of a user.

Moreover, the main body 110 may be expandable to accommodate the at least one item 10. In other words, the main body 110 may at least partially deform in response to receiving the at least one item 10, such that the main body 110 may snugly fit the at least one item 10. More specifically, the main body 110 may have a diameter equivalent to a diameter of the at least one item 10. Alternatively, the main body 110 may be rigid, such that the main body 110 may fit items of a predetermined size equivalent to a predetermined size of an interior of the main body 110.

The base 111 may be disposed on at least a portion of a first end of the main body 110. The base 111 may prevent the at least one item 10 from falling through the main body 110. Additionally, the base 111 may be constructed to support a weight of the at least one item 10.

The aperture 112 may be disposed on at least a portion of a second end of the main body 110. The aperture 112 may receive the at least one item 10 therethrough, such that the main body 110 may store the at least one item 10 therein.

The back support pad 120 may be constructed of nylon, metal, and/or plastic, but is not limited thereto. The back support pad 120 may be disposed on and/or within at least a portion of the main body 110. The back support pad 120 may be more rigid with respect to the main body 110, such that the back support pad 120 may be constructed of material that is more firm and/or hard with respect to the main body 110.

As such, the back support pad 120 may prevent at least a portion of the main body 110 from collapse. In other words, the back support pad 120 may prevent at least a portion of the main body 110 from deforming in response to movement thereto (e.g., where the back support pad 120 is disposed on the main body 110), such as bending by the main body 110. As such, the back support pad 120 may prevent injury to the user by reducing strain to a back of the user while carrying the at least one item 10 in the main body 110, such that the user may expend less energy to keep the main body 110 from collapsing and/or bending.

The shoulder strap assembly 130 may include a first shoulder strap 131 and a second shoulder strap 132, but is not limited thereto.

The first shoulder strap 131 may include a first section 131*a*, a second section 131*b*, and a first shoulder strap fastener 131*c*, but is not limited thereto.

The first section 131*a* and/or the second section 131*b* of the first shoulder strap 131 may be disposed on at least a portion of a top portion of the main body 110. Additionally, the second section 131*b* may be longitudinally disposed a first distance away from the first section 131*a*, such that a first arm of the user may fit between the first section 131*a* and the second section 131*b* of the first shoulder strap 131.

Referring to FIG. 1, the first shoulder strap fastener 131*c* is illustrated to be a buckle. However, the first shoulder strap fastener 131*c* may be hooks and loops, a twine, a string, a rope, a magnet, a clasp, a hook, a screw, a nail, a bolt, a nut, a washer, and/or any combination thereof, but is not limited thereto.

The second shoulder strap 132 may include a first section 132*a*, a second section 132*b*, and a second shoulder strap fastener 132*c*, but is not limited thereto.

The first section 132*a* and/or the second section 132*b* of the second shoulder strap 132 may be disposed on at least another portion of the top portion of the main body 110. Additionally, the second section 132*b* may be longitudinally disposed the first distance away from the first section 132*a*, such that a second arm of the user may fit between the first section 132*a* and the second section 132*b* of the second shoulder strap 132.

Referring again to FIG. 1, the second shoulder strap fastener 132*c* is illustrated to be a buckle. However, the second shoulder strap fastener 132*c* may be hooks and loops, a twine, a string, a rope, a magnet, a clasp, a hook, a screw, a nail, a bolt, a nut, a washer, and/or any combination thereof, but is not limited thereto.

Additionally, the second shoulder strap 132 may be longitudinally disposed a second distance away from the first shoulder strap 131, such that a torso of the user may fit between the first shoulder strap 131 and/or the second shoulder strap 132.

As such, the first shoulder strap 131 may be disposed on a first shoulder of the user, and the second shoulder strap 132 may be disposed on a second shoulder of the user. As such, the first shoulder strap 131 and/or the second shoulder strap 132 may suspend the main body 110 in response to the first shoulder strap 131 and/or the second shoulder strap 132 being disposed on the first shoulder and/or the second shoulder of the user.

Also, the first shoulder strap fastener 131*c* may adjust a length of the first shoulder strap 131, such as increasing the length by moving in a first direction, and decreasing the length by moving in a second direction.

Similarly, the second shoulder strap fastener 132*c* may adjust a length of the second shoulder strap 132, such as increasing the length by moving in the first direction, and decreasing the length by moving in the second direction.

As such, the shoulder strap assembly 130 may by adjusted based on the preference of the user.

The chest strap assembly 140 may include a first chest strap 141, a second chest strap 142, and a chest strap fastener 143, but is not limited thereto.

A first end of the first chest strap 141 and/or a first end of the second chest strap 142 may be disposed on at least a portion of the first shoulder strap 131 and the second shoulder strap 132, respectively. Moreover, the first chest strap 141 and/or the second chest strap 142 may cover a chest of the user.

The chest strap fastener 143 may include hooks and loops, a buckle, a twine, a string, a rope, a magnet, a clasp, a hook, a screw, a nail, a bolt, a nut, a washer, and/or any combination thereof, but is not limited thereto.

The chest strap fastener 143 may connect the second chest strap 142 to the first chest strap 141 around the chest of the user. As such, the chest strap fastener 143 may prevent the first chest strap 141 and the second chest strap 142 from falling off the chest of the user.

The waist strap assembly 150 may include a first waist strap 151, a second waist strap 152, and a waist strap fastener 153, but is not limited thereto.

The first waist strap 151 and/or the second waist strap 152 may be disposed on at least a portion of a bottom portion of the main body 110. Additionally, the second waist strap 152 may be longitudinally disposed a third distance away from the first waist strap 151, such that a waist of the user may fit between the first waist strap 151 and the second waist strap 152.

The waist strap fastener 153 may include hooks and loops, a buckle, a twine, a string, a rope, a magnet, a clasp, a hook, a screw, a nail, a bolt, a nut, a washer, and/or any combination thereof, but is not limited thereto.

The waist strap fastener 153 may connect the second waist strap 152 to the first waist strap 151 around the waist of the user. As such, the waist strap fastener 153 may prevent the first waist strap 151 and/or the second waist strap 152 from falling off the waist of the user.

The gas detection unit 160 may include a gas detection sensor 161, an alarm unit 162, and a power source 163, but is not limited thereto.

The gas detection unit 160 may be disposed on and/or within at least a portion of the main body 110.

The gas detection sensor 161 may include a gas emission sensor, a weight sensor, and an impact sensor, but is not limited thereto.

The gas detection sensor 161 may be configured to detect an emission of gas from the at least one item 10. For example, the gas detection sensor 161 may detect the emission of gas based on a predetermined gas level that indicates a leak from the at least one item 10. Subsequently, the gas detection sensor 161 may transmit a gas leak signal to the alarm unit 162.

The alarm unit 162 may include a light and a speaker, but is not limited thereto.

The alarm unit 162 may illuminate a first illumination, such as a first flashing light, a first color, and/or a steady light, and/or emit a first sound in response to the gas leak signal.

Furthermore, the gas detection sensor 161 may be configured to detect a physical impact to the main body 110 (i.e. dropping the main body 110 on the ground surface and/or the main body 110 being struck by the external object) while the at least one item 10 is stored within the main body 110. In other words, the gas detection sensor 161 may detect a weight of the at least one item 10 and/or the physical impact to the main body 110, such that the gas detection sensor may transmit an impact signal to the alarm unit 162.

Moreover, the alarm unit 162 may illuminate a second illumination, such as a second flashing light, a second color, and/or another steady light, and/or emit a second sound different with respect to the first sound in response to the impact signal.

Alternatively, the alarm unit 162 may be configured to activate the first illumination and/or the second illumination on the outer surface of the main body 110 in response to the gas leak signal, and activate the first sound and/or the second sound on an interior surface of the main body 110 in response to the impact signal. In other words, the alarm unit 162 may illuminate in response to detection of the gas leak by the at least one item 10, and emit sounds in response to detection of the physical impact against the main body 110.

As such, the alarm unit 162 may alert the user using different responses based on the gas leak signal and/or the impact signal. Specifically, the alarm unit 162 may illuminate the first illumination and/or the second illumination on the outer surface of the main body 110 to illuminate the outer surface of the main body 110, such that the user may have a better chance to see the first illumination and/or the second illumination. Additionally, the alarm unit 162 may emit the first sound and/or the second sound on the interior surface of the main body 110 to cause sound reverberation within the main body 110, such that the user may have a better chance to hear the first sound and/or the second sound.

The power source 163 may include a battery and/or a solar cell, but is not limited thereto. As such, the power source 163 may send power to the gas detection sensor 161 and/or the alarm unit 162.

Therefore, the gas tank storage bag 100 may store gas tanks therein, and allow the user to transport the gas tanks without straining hands and/or the back of the user.

The present general inventive concept may include a gas tank storage bag 100, including a cylindrical main body 110 to store at least one item 10 therein, a back support pad 120 disposed on at least a portion of the cylindrical main body 110 to prevent at least a portion of the cylindrical main body 110 from collapsing in response to movement thereto, a shoulder strap assembly 130 disposed on at least a portion of a top portion of the cylindrical main body 110 to suspend the cylindrical main body 110 from shoulders of a user, and a waist strap assembly 150 disposed on at least a portion of a bottom portion of the cylindrical main body 110 to connect around a waist of the user.

The back support pad 120 may be more rigid with respect to the cylindrical main body 110.

The gas tank storage bag 100 may further include a chest strap assembly 140 disposed on at least a portion of the shoulder strap assembly 130 to connect around a chest of the user.

The gas tank storage bag 100 may further include a gas detection unit 160 disposed on at least a portion of the cylindrical main body 110 to activate an alarm unit 162 in response to detection of at least one of an emission of gas and a physical impact to the cylindrical main body 110.

The gas detection unit 160 may illuminate a light on an outer surface of the cylindrical main body 110 in response to detection of the emission of gas, and emit a sound on an interior surface of the cylindrical main body 110 in response to detection of the physical impact to the cylindrical main body 110.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A gas tank storage bag, comprising:

a cylindrical main body to store at least one item therein;

a back support pad disposed on at least a portion of the cylindrical main body to prevent at least a portion of the cylindrical main body from collapsing in response to movement thereto;

a shoulder strap assembly, comprising:

a first shoulder strap, comprising:

a first section disposed on at least a portion of the back support pad to extend away from the back support pad with respect to a first direction, such that the first section is angularly disposed at a first plane different from a plane of a top edge of the cylindrical main body, and a second section disposed on at least a portion of the back support pad to extend away from the back support pad with respect to a second direction, such that the second section is angularly disposed at a second plane different from the first plane and the plane of the top edge of the cylindrical main body, and a second shoulder strap, comprising:

another first section disposed on at least a portion of the back support pad a first distance away from the first section to extend away from the back support pad with respect to a third direction opposite with respect to the second direction, such that the another first section is angularly disposed at a third plane different from the first plane, the second plane, and the plane of the top edge of the cylindrical main body, and another second section disposed on at least a portion of the back support pad a second distance away from the second section to extend away from the back support pad with respect to a fourth direction opposite with respect to the first direction, such that the another second section is angularly disposed at a fourth plane different from the first plane, the second plane, the third plane, and the plane of the top edge of the cylindrical main body; and a waist strap assembly disposed on at least a portion of a bottom portion of the cylindrical main body to connect around a waist of the user.

2. The gas tank storage bag of claim 1, wherein the back support pad is more rigid with respect to the cylindrical main body.

3. The gas tank storage bag of claim 1, further comprising:

a chest strap assembly disposed on at least a portion of the shoulder strap assembly to connect around a chest of the user.

4. The gas tank storage bag of claim 1, further comprising:

a gas detection unit disposed on at least a portion of the cylindrical main body to activate an alarm unit in response to detection of at least one of an emission of gas and a physical impact to the cylindrical main body.

5. The gas tank storage bag of claim 4, wherein the gas detection unit illuminates a light on an outer surface of the cylindrical main body in response to detection of the emission of gas, and emits a sound on an interior surface of the cylindrical main body in response to detection of the physical impact to the cylindrical main body.

6. A gas tank storage bag, comprising:

a cylindrical main body to store at least one gas tank therein;

a back support pad constructed of metal and plastic disposed on at least a portion of the cylindrical main body to prevent at least a portion of the cylindrical main body from collapsing in response to movement thereto;

a shoulder strap assembly disposed on at least a portion of the back support pad to suspend the cylindrical main body from shoulders of a user;

a waist strap assembly disposed on at least a portion of a bottom portion of the cylindrical main body to connect around a waist of the user; and a gas detection unit disposed within at least a portion of the cylindrical main body, the gas detection unit comprising:

a gas detection sensor to transmit a gas leak signal in response to detection of a gas leak, and transmit an impact signal in response to detection of a weight of the gas tank and a physical impact to the cylindrical main body, and an alarm unit to illuminate a light on an outer surface of the cylindrical main body in response to receiving the gas leak signal, and emit a sound on an interior surface of the cylindrical main body in response to receiving the impact signal, such that the cylindrical main body causes sound reverberation therein.

* * * * *